US007307229B2

(12) United States Patent
Bonn et al.

(10) Patent No.: US 7,307,229 B2
(45) Date of Patent: Dec. 11, 2007

(54) SWITCH PROVIDED WITH SELF-CLEANING CONTACTS

(75) Inventors: Helmut Bonn, Haibach (DE); Uwe Esskuchen, Essweiler (DE)

(73) Assignee: Takata-Petri AG, Aschaffenburg (DE)

( * ) Notice: Subject to any disclaimer, the term of this patent is extended or adjusted under 35 U.S.C. 154(b) by 0 days.

(21) Appl. No.: 10/546,105

(22) PCT Filed: Jan. 29, 2004

(86) PCT No.: PCT/DE2004/000170

§ 371 (c)(1),
(2), (4) Date: May 12, 2006

(87) PCT Pub. No.: WO2004/075223

PCT Pub. Date: Sep. 2, 2004

(65) Prior Publication Data

US 2006/0207866 A1 Sep. 21, 2006

(30) Foreign Application Priority Data

Feb. 20, 2003 (DE) ..... 203 03 116 U

(51) Int. Cl.
*H01H 9/00* (2006.01)
*H01H 27/06* (2006.01)

(52) U.S. Cl. ..... 200/61.54; 200/253

(58) Field of Classification Search ..... 200/61.54, 200/61.55

See application file for complete search history.

(56) References Cited

U.S. PATENT DOCUMENTS 3,002,074 A 9/1961 Eadie, Jr.
3,201,555 A 8/1965 Lacan et al.
4,739,127 A 4/1988 Higuchi et al.

(Continued)

FOREIGN PATENT DOCUMENTS

DE 195 501 A 4/1907

(Continued)

OTHER PUBLICATIONS

English Translation of International Preliminary Report on Patentability Chapter II for PCT/DE2004/000170.

*Primary Examiner*—Elvin Enad
*Assistant Examiner*—Lheiren Mae A. Anglo
(74) *Attorney, Agent, or Firm*—Fitch, Even, Tabin & Flannery

(57) ABSTRACT

The invention relates to a switch provided with self-cleaning contacts used, in particular for actuating a horn for a steering wheel of a motor vehicle. The inventive switch comprises at least two opposite contacts one of which is movable and touches the opposite contact by means of an actuating element. The self-cleaning of the contacts is carried out by the reciprocal sliding thereof, the contact associated with the actuating element is fixed to a supporting element which is embodied in such a way that it is elastic and fixed to an end, an opposite end being free and moveable. Said invention is characterized in that the supporting element from the fixing side outward has an inclined line with respect to the direction of actuation in the direction of said actuating element, and subsequently in the direction of the free end thereof. A line is also inclined in the direction of the free end thereof with respect to the direction of actuation starting from the actuating element.

21 Claims, 4 Drawing Sheets

U.S. PATENT DOCUMENTS

| | | | | |
|---|---|---|---|---|
| 5,193,412 | A * | 3/1993 | Hashiba | 74/552 |
| 5,303,952 | A * | 4/1994 | Shermetaro et al. | 280/731 |
| 5,338,906 | A * | 8/1994 | Yokota | 200/61.54 |
| 6,143,994 | A | 11/2000 | Thivilier | |
| 6,803,533 | B2 * | 10/2004 | Bonn et al. | 200/61.55 |
| 7,112,754 | B2 * | 9/2006 | Holzel et al. | 200/242 |

FOREIGN PATENT DOCUMENTS

| | | | |
|---|---|---|---|
| DE | 667 850 | A | 10/1938 |
| DE | 32 890 | | 11/1964 |
| DE | 41 17 120 | A1 | 11/1992 |
| DE | 200 04 953 | U1 | 9/2000 |
| EP | 0 689 215 | A1 | 12/1995 |
| GB | 903 169 | | 8/1962 |
| GB | 2 207 554 | A | 2/1989 |
| JP | 11297147 | A | 10/1999 |
| WO | WO 01/66383 | A1 | 9/2001 |

* cited by examiner

SWITCH PROVIDED WITH SELF-CLEANING CONTACTS

The invention relates to a switch with self-cleaning contacts.

BACKGROUND OF THE INVENTION

WO 01/66383 A1 discloses a steering wheel for motor vehicles having a device for activating an electric function group of a motor vehicle, in which one contact is mounted on an assembly of the steering wheel skeleton and the other contact located opposite is mounted on an assembly which is movable with respect to the steering wheel skeleton. The contact which is arranged on the movable assembly is spring-mounted and can therefore slide along the other contact when it is pressed down. Owing to the friction which occurs as a result of this, the contacts are cleaned of soiling and/or an oxide layer is removed from them.

One disadvantage of this arrangement is that the maximum travel of the self-cleaning process of the movable contact with respect to the corresponding contact corresponds to the displacement travel of the activation element in the direction of the corresponding contact after the two contacts are in contact with one another, assuming that the sprung contact carrier is arranged at an angle of 45° with respect to the direction of movement of the activation element. Therefore, if the activation device is moved on by a millimeter after the two contacts have been in contact with one another, the contacts also slide against one another by a millimeter. Although changing the abovementioned angle allows the sliding travel of the movable contact to be increased within certain limits, it remains small. When the displacement travel of the activating element is increased, there would be the further disadvantage that when the switch is activated by pressing down the airbag cover cap the dimensions of the gap between the latter and the steering wheel would have to be made larger.

SUMMARY OF THE INVENTION

The invention is therefore based on the object of improving the ratio of the displacement travel of the activation element for the switch to the travel of the self-cleaning process of the contacts, i.e. to make the travel for the self-cleaning process larger with the same displacement travel as a known switching device.

This is achieved in accordance with the features of the invention described hereinafter.

In a switch with self-cleaning contacts, in particular for activating horns on steering wheels of motor vehicles, having at least two contacts located one opposite the other, a movable contact of which can be placed in contact with a corresponding contact by means of an activation element, with the contacts sliding against one another during the contact-making process for the purpose of self-cleaning by the contact which is assigned to the activation element being attached to a carrier element which can be elastically deformed and is secured at one end while the end located opposite is freely movable, according to the invention the carrier element extends obliquely with respect to the direction of activation from its attachment side in the direction of the activation element, and subsequently extends obliquely with respect to the direction of activation towards its free end and away from the activation element.

The carrier element therefore has two oblique sections which extend at least in certain sections in the manner of two sides of a triangle whose point of intersection lies in the region of the activation element. It is expedient that the oblique sections extend at the same angle with respect to the direction of activation.

If the activation element is pressed, for example, by pressing down the airbag cover cap, onto the elastic carrier element which is clamped in on one side, the contact of said carrier element with the corresponding contact is electrically short-circuited. The oblique surfaces of the carrier element which are located on the left and right of the activation element make their angles with one another larger after contact is made when the activation element is pressed down further. As a result, the contact of the carrier element with the corresponding contact is displaced with a predetermined supporting force and the surface of the contact is cleaned of soiling. As a result of the fact that one side of the carrier element is fixed, preferably is permanently connected to one of side of a switch housing, and only the other side can be deflected, when the carrier element is subjected to travel in the direction of movement of the activation element of, for example, one millimeter, the contacts are displaced with respect to one another by 2 millimeters. The travel of the self-cleaning process has therefore doubled in comparison with the arrangement according to the prior art, or for a specific displacement of the contacts against one another, the activation element has to be pressed in only half as far in comparison with the arrangement according to the prior art. When the switch is activated by means of the airbag cover cap, the dimensions of the gap between the latter and the steering wheel can therefore be reduced.

It is expedient that the carrier element is accommodated in a switch housing which is preferably closed off with a lid in order to prevent the penetration of relatively large particles of dirt between the contact and corresponding contact.

In one embodiment, the carrier element is constructed in the manner of a dome in the direction of the activation element and projects out of the switch housing, with the oblique sections of the carrier element extending between the dome-like section and the contact side on the one hand, and the attachment side of the carrier element on the other.

In this first embodiment the activation element is embodied in such a way that after the dome-like section has been pressed down until it terminates flush with the housing wall it bears against said housing wall. This ensures that the pressure on the carrier element, and thus on the contacts, is limited to a predefinable value. The protruding amount of the dome-like section of the carrier element with respect to the housing is configured to be so large that the contacts are cleaned but the elastic carrier element is not overloaded.

In a second embodiment, the carrier element has a curvature in the direction of the activation element, which curvature extends inside the switch housing, and an activation bolt is arranged in the switch housing between the carrier element and the activation element, which activation bolt has a stop which bears against the inner wall of the housing in the state of rest. In this context, the activation bolt is pressed against the inner wall of the housing by the spring force of the carrier element.

It is expedient that the corresponding contact is also arranged on a carrier element in the switch housing. The carrier elements are preferably embodied as electrically conductive contact plates on which plug vanes, which can be connected to electrical lines or plates, are mounted. The carrier elements are attached in particular by integration by injection molding or latching in the switch housing composed of insulating material and are preferably attached to one side of the switch housing.

A stop in the switch housing can be assigned to the carrier element which is assigned to the activation element, in order to bring about a defined position of rest. The carrier element is prestressed against this stop, as a result of which the distance between the contact and the corresponding contact can be better maintained. The stop is expediently arranged in the contact area.

The contact and the corresponding contact are preferably arranged at the free end of the assigned carrier element.

In one embodiment, the carrier element for the corresponding contact is permanently connected to the switch housing over the entire length of said carrier element. In a second embodiment, the carrier element for the corresponding contact is manufactured from sprung material and is freely movable in the region of the corresponding contact. As a result, the contact force between the contact and the corresponding contact can be better matched.

In order to bring about a good cleaning effect, one contact has a curved surface shape and the contact located opposite has a flat, ribbed surface shape. The corresponding contact preferably has the curved surface shape.

To prevent the abrasion on the contact surfaces being too large, the activation element should be embodied in such a way that the contact force between the two carrier elements does not exceed the value of 2+1N.

The carrier element which is assigned to the activation element preferably has a round or angular cross section.

In a motor vehicle, the switch can be arranged in the steering wheel or in the airbag module.

It may expediently also be arranged on a scissor device which is installed in the steering wheel or in the airbag cap, with one scissor element bearing the switch and the other scissor element having an activation element for the switch. The scissor device ensures that the required activation force is always equal in magnitude irrespective of whether, for example, the airbag cap is pressed down in the center or at the edge when the switch is activated.

The switch according to the invention can be used in particular for sounding a horn in a motor vehicle.

BRIEF DESCRIPTION OF THE DRAWINGS

The invention will be explained in exemplary embodiments with reference to drawings, in which.

DETAILED DESCRIPTION OF THE PREFERRED EMBODIMENTS

Figure 1:
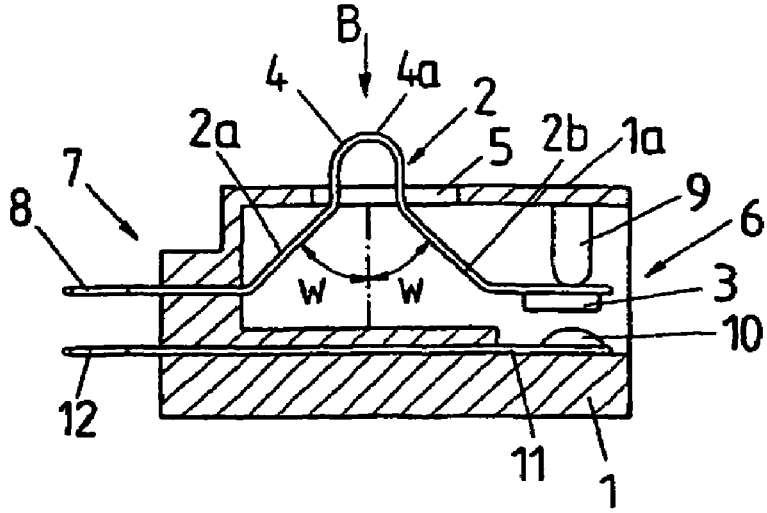
FIG. 1 shows a section through a first embodiment of a switch according to the invention.
Figure 2:
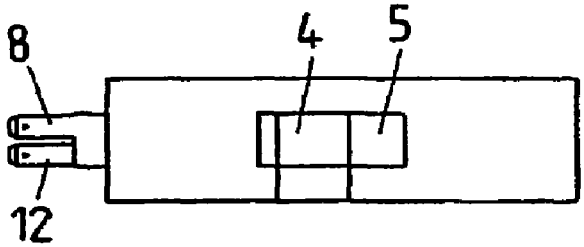
FIG. 2 shows a plan view of the switch according to FIG. 1.

In the switch illustrated in FIG. 1, an elastic, electrically-conductive carrier element 2 in the form of a contact plate with a contact 3 is arranged in a switch housing 1 made of insulating material. The carrier element 2 has a dome-like section 4 which projects out of the switch housing 1 through a slit-shaped opening 5. The carrier element extends obliquely with respect to the direction B of activation between the dome-like section 4 and the contact side 6 on the one hand and the activation side 7 of the carrier element 2 on the other. The oblique sections 2*a, b* extend at the same angle w with the respect to the direction of activation. The carrier element 2 is provided with a plug vane 8 for connection to an electrical line. Furthermore, the carrier element 2 bears with prestress against a stop 9 in the region of the contact 3 so that in the position of rest a constant contact distance from a corresponding contact 10 is ensured. The latter is attached to an electrically conductive carrier element 11 which has a plug vane 12. In this embodiment, the carrier element 11 rests on the bottom of the switch housing 1 so that it cannot be deformed by the pressing down of the contact 3.

Figure 4:
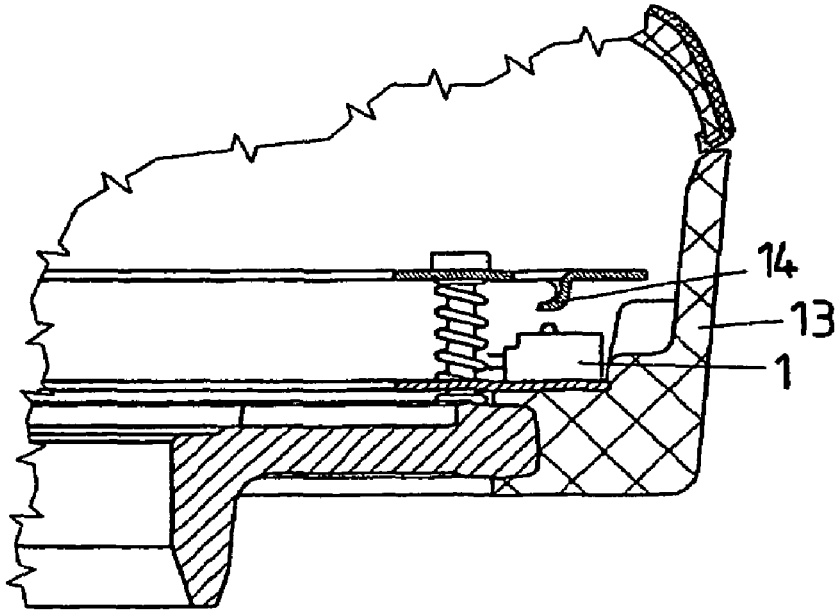
FIG. 4 shows the switch in the installation position in a steering wheel.

The illustrated switch can, as illustrated in FIG. 4, be installed in a steering wheel 13 and be activated by an activation element 14. In this context, the activation element 14 is embodied in such a way that when it is pressed down it cannot enter the opening 5 of the switch housing 1. As a result, the dome-like section 4 of the carrier element 2 can be pressed down only until its upper end 4*a* is flush with the outer face 1*a* of the switch housing 1.

Figure 3:
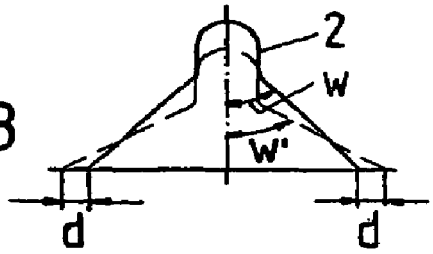
FIG. 3 shows a detail from FIG. 1.

During the pressing-down process, the carrier element 2 deforms as illustrated by dashed lines in FIG. 3. In the process, the angle w between the oblique surface and the direction of activation becomes larger after contact is made at the angle w', and given free mobility the ends of the oblique surface would be displaced horizontally on both sides by the amount d. However, since the carrier element 2 is clamped in on the left-hand side and only the right-hand side with the contact 3 attached to it can be deflected, with the dome-like section 4 being displaced in the opening 5, said section is moved to the right by twice the amount 2*d*. Since both contacts rest one on top of the other here, the surfaces of the two contacts are cleaned of soiling during this movement. The cleaning is promoted by the fact that the contact 3 has a level, ribbed surface, while the corresponding contact 10 has a convexly curved surface.

Figure 5:
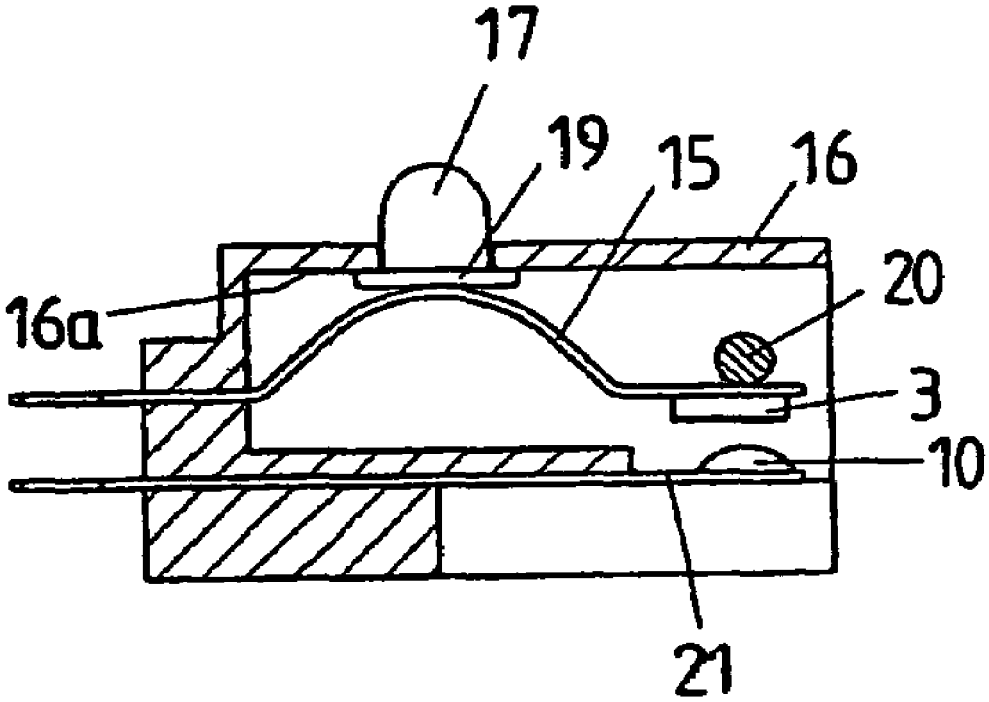
FIG. 5 shows a section through a second embodiment of the switch according to the invention.
Figure 6:
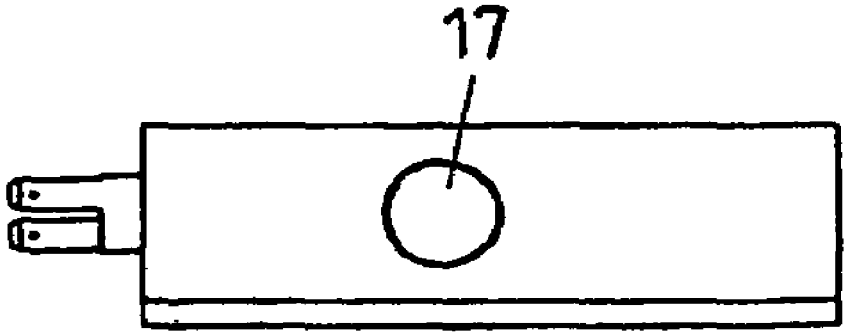
FIG. 6 shows a plan view of the switch according to FIG. 5.

In the embodiment in FIGS. 5 and 6, an electrically conductive, elastic carrier element 15 has a curvature in the direction of a activation element 14, which curvature extends within a switch housing 16. An activation bolt 17 is arranged between the carrier element 15 and the activation element 14 (FIG. 4 and not illustrated in this figure) in the switch housing 16 which has a stop 19 which bears against the inner wall 16*a* of the housing in the state of rest. The opening in the switch housing 16 for the activation bolt 17 is only slightly larger than its diameter so that good guidance but also ease of movement are ensured. The carrier element 15 bears against a stop 20 with prestress in the region of the contact 3. The end of the electrically conductive, elastic carrier element 21 with the corresponding contact 10 lies unattached in the switch housing in this embodiment, so that it can deform elastically under the pressure of the contact 3.

Since this carrier element 15 also has oblique surfaces on both sides of the activation bolt 17 due to the curvature, and is clamped into the switch housing 16 at one end, the same effect occurs when the switch is activated as in the first embodiment.

Figure 7:
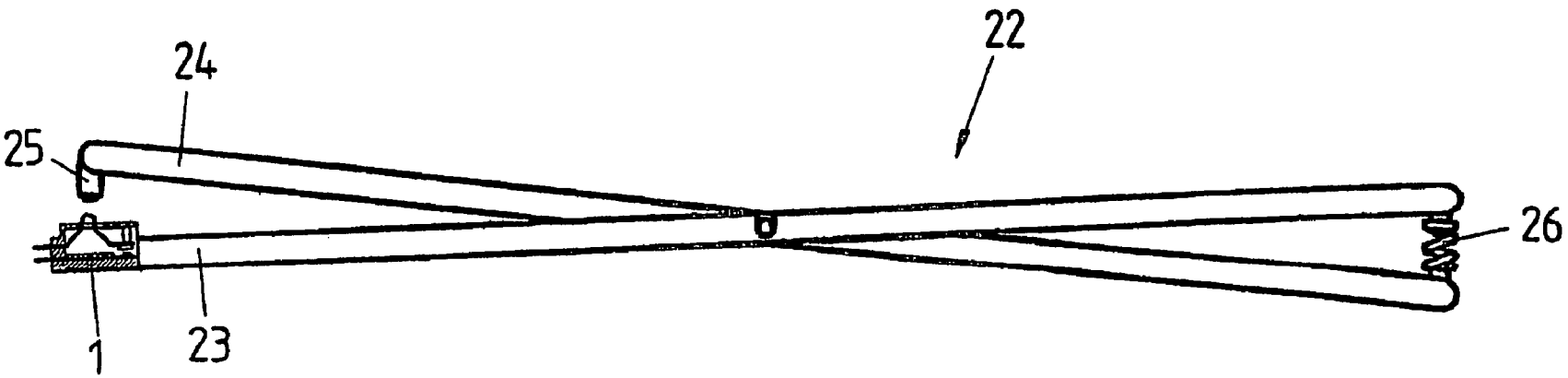
FIG. 7 shows a switch according to the invention which is arranged on a scissor device.
Figure 8:
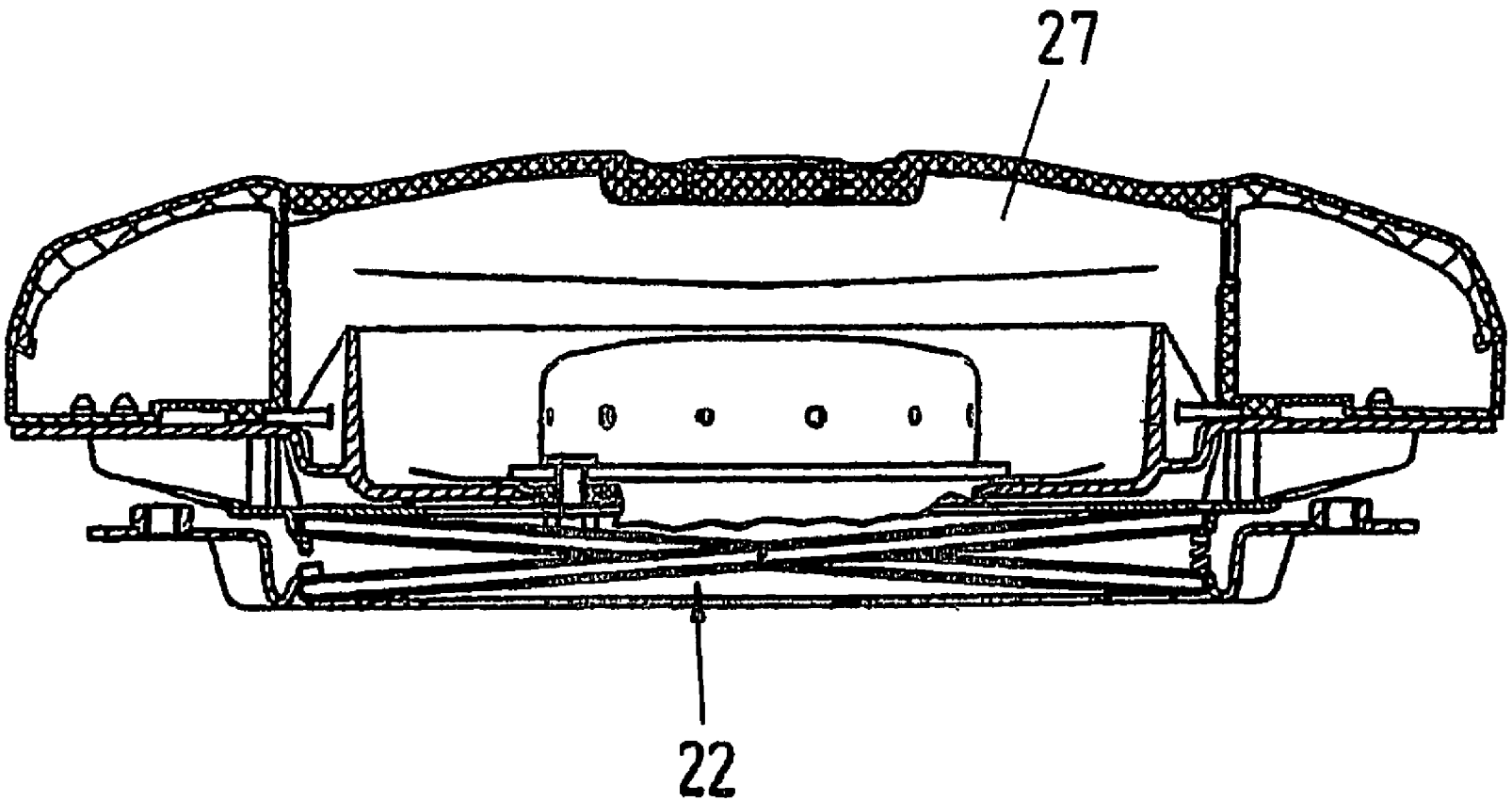
FIG. 8 shows the scissor device according to FIG. 7 in an installed position in the steering wheel.

FIGS. 7 and 8, illustrate a possible way—which differs from FIG. 1—of installing a switch according to the invention in an airbag module. The switch housing 1 is attached at one end of a scissor element 23 of a scissor device 22 while an activation element 25 is arranged at one end of an assigned scissor element 24. The respective other ends of the scissor elements are connected by a compression spring 26.

The scissor device 22 is arranged in an airbag module as illustrated in FIG. 8. The scissor device has the advantage that the activation force for the switch is always the same irrespective of whether the switch is activated by pressure on the center or the edge of the airbag cover.

The invention claimed is:

1. A push switch with self-cleaning contacts, in particular for activating horns on steering wheels of motor vehicles, having at least two contacts located one opposite the other, a movable contact of which can be placed in contact with a corresponding contact by means of an activation element, wherein the contacts slide against one another during the contact-making process for the purpose of self-cleaning by the contact which is assigned to the activation element being attached to a carrier element having ends thereof, the carrier element being elastically deformable and secured at one of the ends thereof while the other end is freely movable, characterized in that the carrier element has oblique sections with one of the oblique sections extending obliquely with respect to the direction of activation from the secured, one end of the carrier element in the direction of the activation element, and another one of the oblique sections extends obliquely with respect to the direction of activation towards the freely moveable, other end of the carrier element and away from the activation element, wherein each oblique section of the carrier element and the direction of movement of the activation element form respective angles therebetween that become larger when said activation element is pressed down on to the carrier element.

2. The push switch as claimed in claim 1, wherein the respective angles between the oblique sections and the direction of activation are equal.

3. The push switch as claimed in claim 1, characterized in that the carrier element is arranged in a switch housing.

4. The push switch as claimed in claim 3, characterized in that the carrier element has a dome-like section disposed in the direction of the activation element and which projects out of the switch housing, and in that the oblique sections of the carrier element extend between the dome-like section and the secured and freely moveable ends of the carrier element.

5. The push switch as claimed in claim 4, characterized in that the housing has an outer face, and the activation element is embodied in such a way that after the dome-like section has been pressed down until the dome-like section terminates flush with the outer face of the housing, the activation element bears against said housing.

6. The push switch as claimed in claim 3, characterized in that the carrier element has a curvature in the direction of the activation element, which curvature extends inside the switch housing, and in that an activation bolt is arranged in the switch housing between the carrier element and the activation element, which activation bolt has a stop which bears against the inner wall of the housing in the state of rest.

7. The push switch as claimed in claim 3, characterized in that the corresponding contact is arranged on a carrier element.

8. The push switch as claimed in claim 7, characterized in that the carrier elements are embodied as electrically conductive contact plates on which plug vanes which can be connected to electrical lines or plates, are mounted.

9. The push switch as claimed in claim 7, characterized in that the carrier elements are attached to one side of the switch housing which is composed of insulating material.

10. The push switch as claimed in claim 9, characterized in that the carrier elements are attached by integration by injection molding or latching in the switch housing.

11. The push switch as claimed in claim 7, characterized in that the moveable contact and the corresponding contact are arranged at the free end of the respective assigned carrier elements.

12. The push switch as claimed in claim 11, characterized in that the carrier element for the corresponding contact is permanently connected to the switch housing over the entire length of said carrier element.

13. The push switch as claimed in claim 11, characterized in that the carrier element for the corresponding contact is manufactured from sprung material and is freely movable in the region of the corresponding contact.

14. The push switch as claimed in claim 3, characterized in that a stop in the switch housing is assigned to the carrier element which is assigned to the activation element, in order to bring about a defined position of rest.

15. The push switch as claimed in claim 14, characterized in that the stop is provided adjacent the moveable contact.

16. The push switch as claimed in claim 1, characterized in that one contact has a curved surface shape and the contact located opposite has a flat, ribbed surface shape.

17. The push switch as claimed in claim 16, characterized in that the corresponding contact has the curved surface shape.

18. The push switch as claimed in claim 1, characterized in that the activation element is embodied in such a way that a predetermined contact force between the two carrier elements is not exceeded.

19. The push switch as claimed in claim 1, characterized in that the carrier element which is assigned to the activation element has a round or angular cross section.

20. The push switch as claimed in claim 1, characterized in that the push switch is arranged in the steering wheel or in an air bag module.

21. The push switch as claimed in claim 1, characterized in that the push switch is arranged on a scissor arrangement, wherein one scissor element bears the switch and the other scissor element has an activation element for the switch.

* * * * *